US005944379A

United States Patent [19]

Yates

[11] Patent Number: 5,944,379

[45] Date of Patent: Aug. 31, 1999

[54] PORTABLE SPECTATOR SEAT FOR USE ON STADIUM BENCHES

[76] Inventor: Donald Yates, 425 Majoliea Rd., Salisbury, N.C. 28147

[21] Appl. No.: 09/042,110

[22] Filed: Mar. 13, 1998

[51] Int. Cl.[6] ..... A47C 4/00; A47D 1/02

[52] U.S. Cl. ..... 297/129; 297/17; 297/230.12; 297/252; 297/230.1

[58] Field of Search ..... 297/129, 17, 219.1, 297/230.1, 230.12, 252, 250.1, 440.12

[56] References Cited

U.S. PATENT DOCUMENTS

| | | | |
|---|---|---|---|
| 168,402 | 10/1875 | Laumonier | 297/129 X |
| 1,140,997 | 5/1915 | Minehart | 297/129 X |
| 2,528,433 | 10/1950 | Hines | 297/252 X |
| 2,577,949 | 12/1951 | Barrett | 297/230.12 X |
| 2,736,365 | 2/1956 | Hines | 297/252 X |
| 2,816,871 | 12/1957 | Fish | 297/252 X |
| 3,419,309 | 12/1968 | Smith | 297/17 X |
| 3,544,157 | 12/1970 | Muller | 297/17 X |
| 3,825,298 | 7/1974 | Chipman | 297/129 |
| 4,611,852 | 9/1986 | Filer | 297/252 X |
| 4,746,166 | 5/1988 | Sadan | 277/17 |
| 4,775,188 | 10/1988 | Fuchs et al. | 297/129 X |
| 4,826,242 | 5/1989 | Trethewey | 297/17 X |
| 5,190,344 | 3/1993 | Anderson et al. | 297/17 |
| 5,205,610 | 4/1993 | Reninger | 297/17 X |
| 5,385,390 | 1/1995 | Freeman et al. | 297/17 X |
| 5,421,637 | 6/1995 | Lemburg | 297/129 X |

FOREIGN PATENT DOCUMENTS

| | | | |
|---|---|---|---|
| 644351 | 7/1962 | Canada | 297/129 |

*Primary Examiner*—Jose V. Chen
*Assistant Examiner*—Rodney B. White
*Attorney, Agent, or Firm*—Clifton Ted Hunt

[57] ABSTRACT

A portable spectator seat for use on stadium benches which includes a seat portion and a backrest that an individual user may easily fold together for carrying and easily unfold into an open position for use. In use, the seat portion rests on a stadium bench and the backrest extends upwardly from the back of the seat portion. The seat portion is strapped to the backrest by scissor hinges that prevent relative movement of the seat portion and backrest while the seat portion is occupied by a user. The spectator seat is light weight for easy carrying and is made from a suitably durable plastic or metal.

2 Claims, 3 Drawing Sheets

PORTABLE SPECTATOR SEAT FOR USE ON STADIUM BENCHES

FIELD OF THE INVENTION

This invention relates to portable seating for individual use on stadium benches as at race tracks, football fields and the like.

BACKGROUND OF THE INVENTION

Most spectators attending events at race tracks, football fields and the like sit in the bleachers on stadium benches which are rows of flat boards arranged in tiers. No support is provided for the spectator's backs, and spectators frequently become uncomfortable while watching an event.

SUMMARY OF THE INVENTION

The spectator seat of this invention has a seat portion with a backrest that an individual user may easily fold together for carrying and easily unfold into an open position for use. In use, the seat portion rests on a stadium bench and the backrest extends upwardly at a comfortable angle from the back of the seat portion. The spectator seat is light weight for easy carrying and is made from a suitably durable plastic or metal.

DETAILED DESCRIPTION OF THE INVENTION

Figure 1:
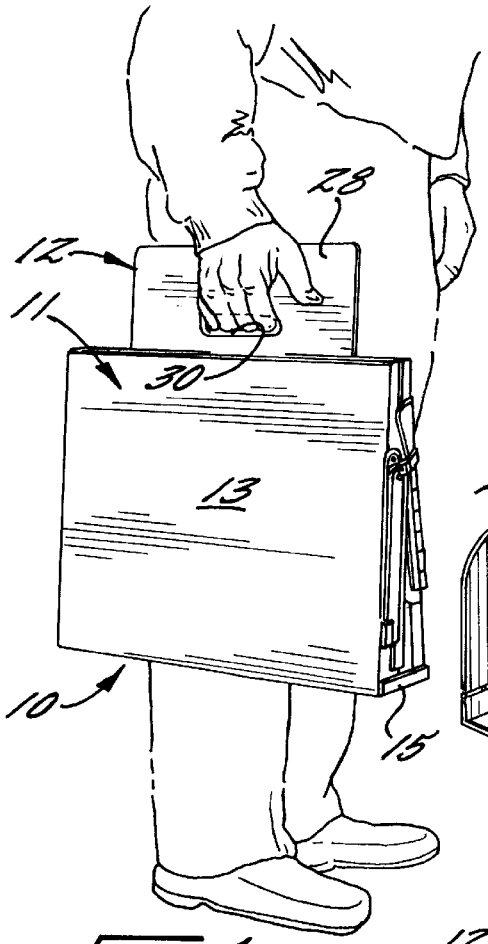
FIG. 1 is a perspective view showing the spectator seat folded to closed position and illustrating the ease with which it may be carried to and from a stadium.
Figure 2:
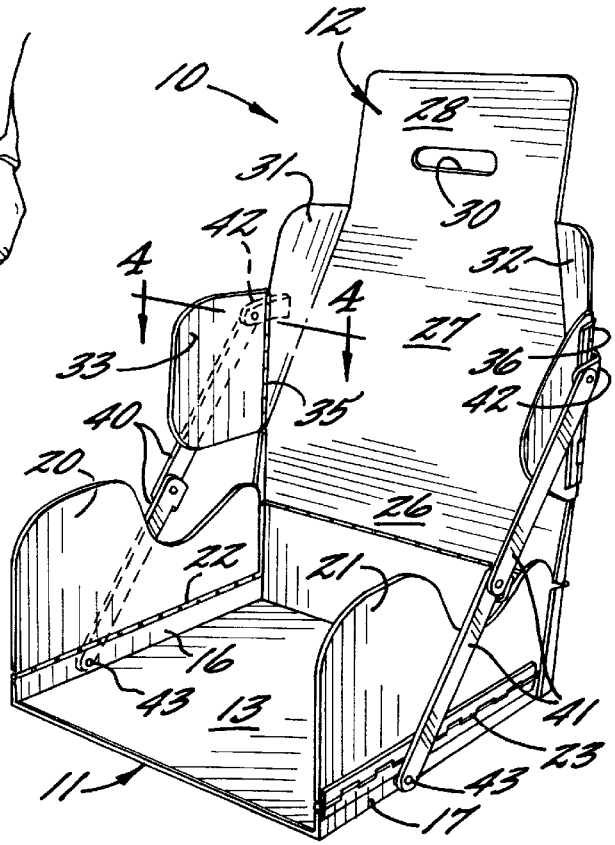
FIG. 2 is a perspective view showing the spectator seat after it has been unfolded for use and the seat portion has been positioned on a stadium bench, not shown.
Figure 4:
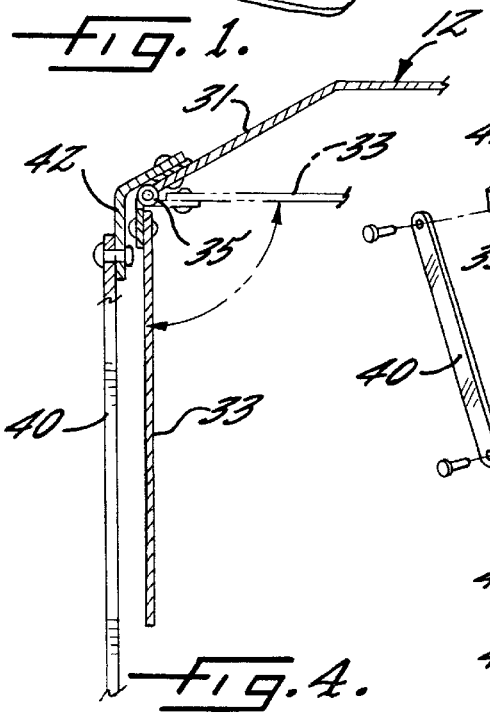
FIG. 4 is a sectional view taken substantially along the line 4—4 in FIG. 2.

The spectator seat, broadly indicated at 10, comprises a seat portion broadly indicated at 11 and a backrest broadly indicated at 12. The seat portion 11 includes a flat base 13, an upturned rear wall 15 extending from the rear of the base 13 and relatively short side walls 16 and 17 turned up from the sides of the base. Side slappers 20 and 21 are connected by piano hinges 22 and 23 to the upper edges of the side walls 16 and 17, respectively.

Figure 3:
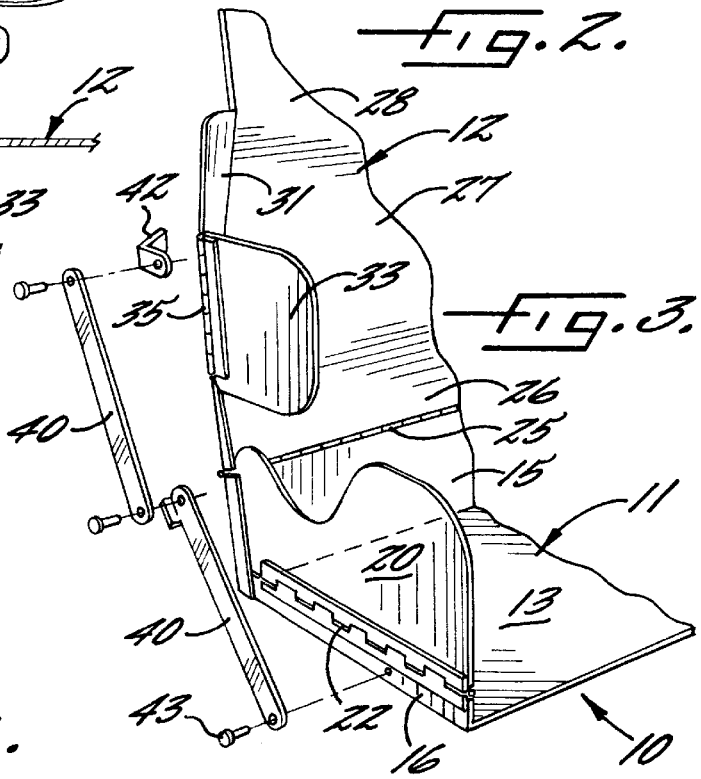
FIG. 3 is a partially exploded perspective view with parts broken away, looking at the side not shown in FIG. 2 and illustrating the pivotal connection of the backrest to the seat portion.
Figure 5:
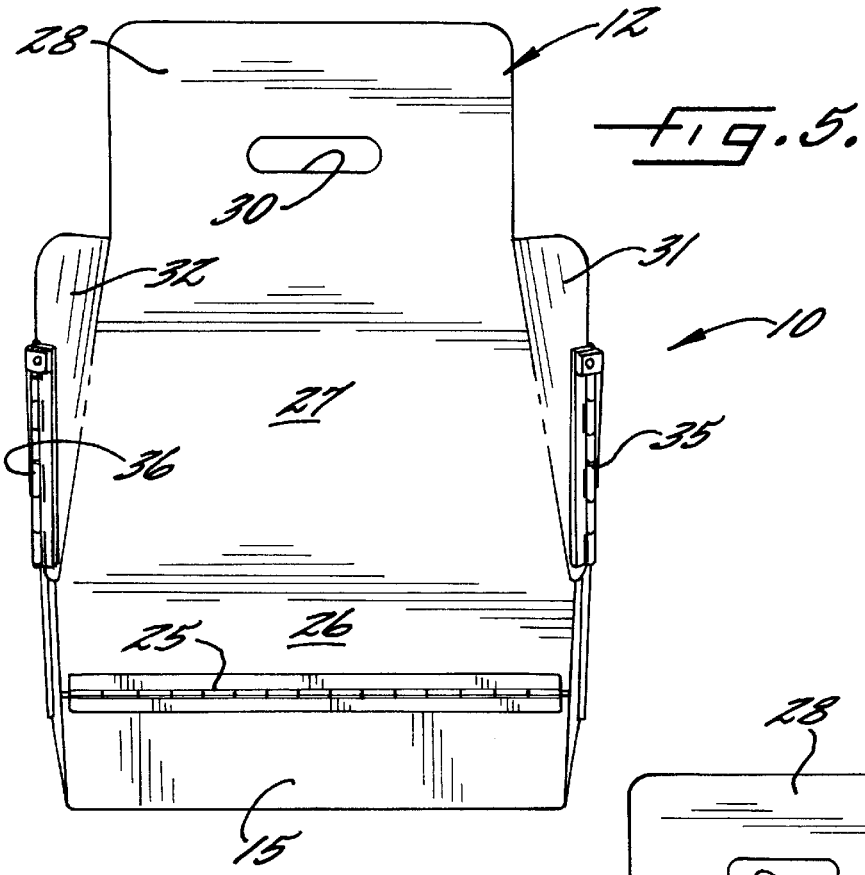
FIG. 5 is a rear view of the spectator seat in its open position.

The backrest 12 is connected by a piano hinge 25 to the upper edge of the rear wall 15 of the spectator seat. The backrest 12 is preferably shaped, as illustrated in the drawings, with a lower portion 26 that is hinged to the rear wall 15, a mid portion 27 that extends in the same plane as the lower portion 26, and an upper portion 28 extending in the same plane as the lower and mid portions of the backrest 12. The upper portion 28 has a slot 30 that serves as a handle for carrying the seat 10, as illustrated in FIG. 1. Outwardly flared wings 31 and 32 extend outwardly from the sides of the backrest 12 at its mid portion 27. Side flaps 33 and 34 are joined by piano hinge as at 35 and 36 to the front edges of the wings 31 and 32. A scissor hinge 40 extends between the wing 31 and the side wall 16, as best seen in FIG. 3. A corresponding scissor hinge 41 extends between the wing 32 and side wall 17. Brackets 42 connect the upper ends of the hinges 40 and 41 to the wings 31 and 32 and the lower ends of the hinges 40 and 41 are connected to the side walls 16 and 17 as by bolts 43.

Figure 6:
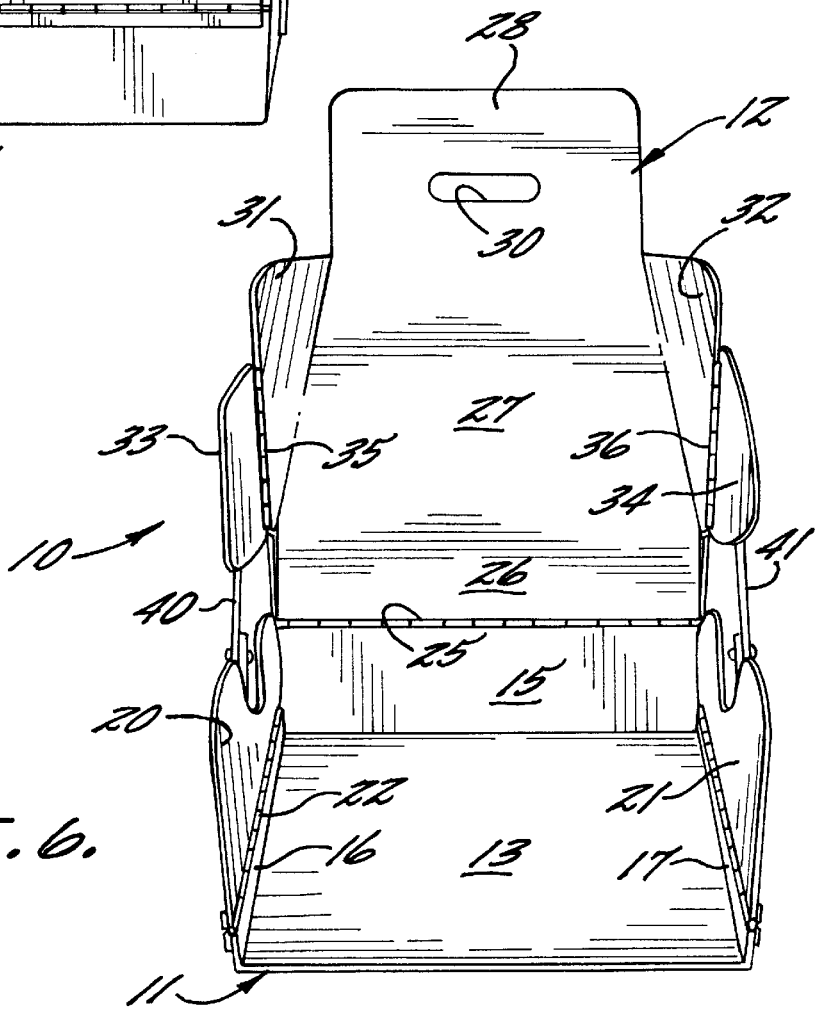
FIG. 6 is a front view of the spectator seat in its open position.

FIG. 6 is a front view of the seat 10 in its open position and ready for use as a spectator seat. In use, the flat base 13 of the opened spectator seat 10 is placed on a stadium bench and the user sits on the flat base. When the user leans against the backrest while sitting on the flat base, the scissor hinges 40 and 41 prevent movement of the backrest 12 relative to the seat portion 11 and the user's weight on the seat portion stabilizes the spectator seat during its use.

Figure 7:
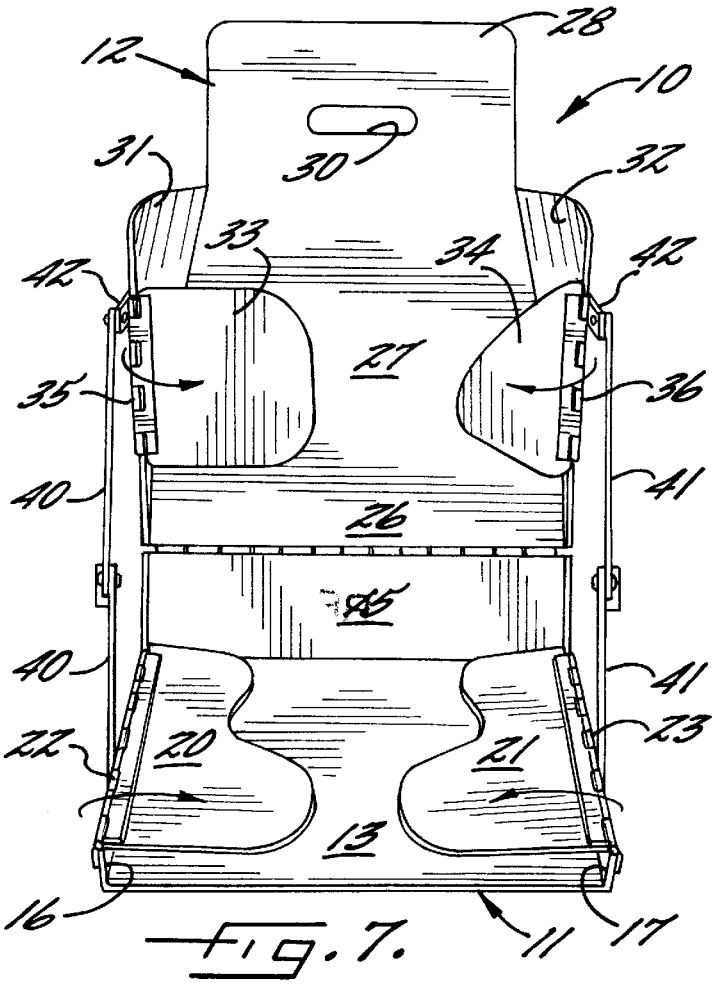
FIG. 7 is a front view similar to FIG. 6 but illustrating the inward folding of the flaps on the backrest and of the side slappers on the seat portion preparatory to folding the spectator seat to its closed position.
Figure 9:
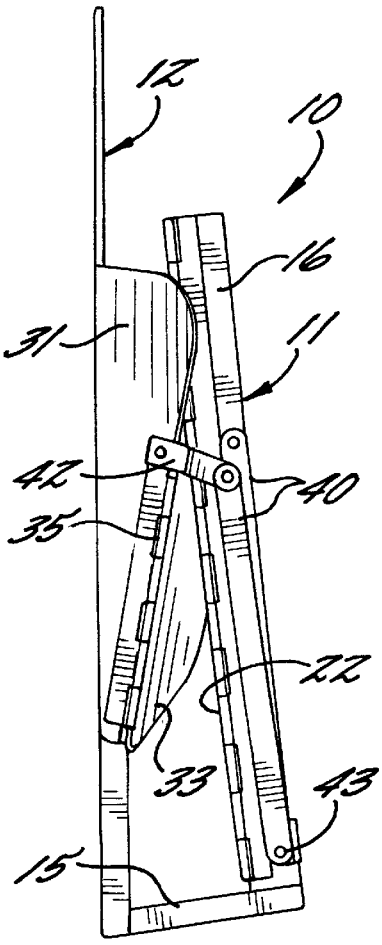
FIG. 9 is a side view of the spectator seat in in its closed position.
Figure 8:
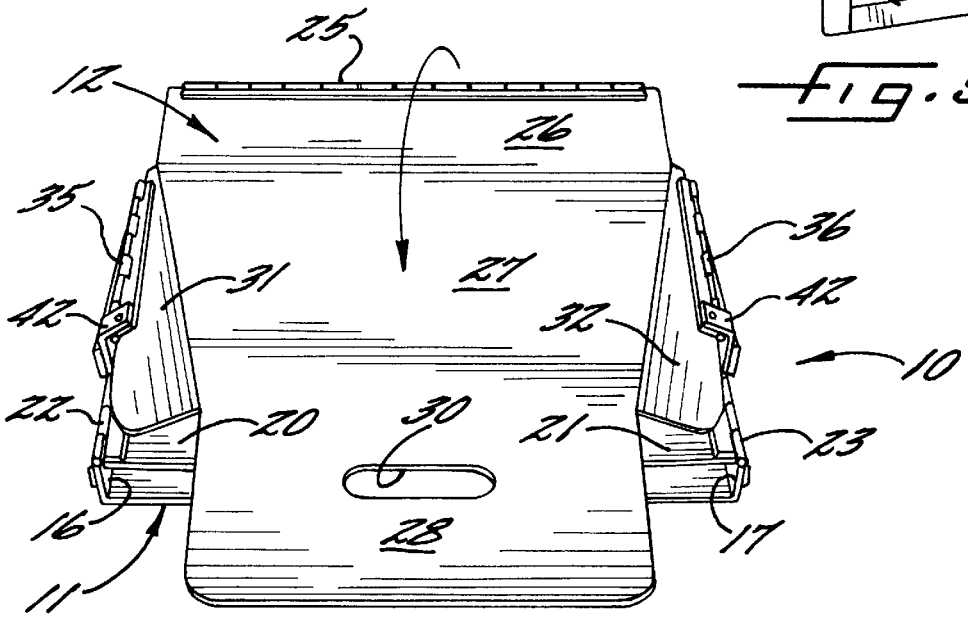
FIG. 8 is a perspective view of the spectator seat in its closed position, looking at the back of the backrest after it has been folded over the seat portion.

FIGS. 7 and 8 illustrate the steps that are taken to fold the seat 10 from the open position of FIG. 6 to the closed position of FIGS. 1 and 9 to be carried or stored between uses. The first step in folding the chair to the closed position is to fold the side slappers 20 and 21 into overlying relation with the base 13 and to fold the flaps 33 and 34 inwardly toward each other as indicated in FIG. 7. Next, the scissor hinges 40 and 41 are manipulated to fold the backrest 12 about the piano hinge 25 toward the seat portion 11, resulting in the rear wall 15 of the seat portion 11 being moved to a supporting position and the slot 30 being located at the top of the folded seat to serve as a handle.

There is thus provided a spectator seat with a comfortable backrest that is easily folded into and out of its open or in-use position and readily carried to and from different events.

Although specific terms have been used in describing the invention, they have been used in a generic and descriptive sense only and not for the purpose of limitation, the scope of the invention being defined in the following claims.

I claim:

1. A portable spectator seat comprising:

a seat portion including:

a base;

a rear wall extending from the base;

a pair of side walls extending from the base and a side slapper hinged to each side wall of the base;

a backrest including:

a lower portion adjoining the rear wall of the seat portion;

a mid portion adjoining the rear wall of the seat portion;

wings extending from the mid portion of the backrest and side flaps hinged to the wings; and scissor hinges extending from the wings on the backrest to the side walls on the seat portion.

2. A portable spectator seat for use on a stadium bench, the spectator seat comprising a seat portion including;

a flat base for engagement with the stadium bench when the spectator seat is folded open for use, side walls extending from the flat base, side slappers extending from the side walls, a backrest, means for holding the seat portion and backrest to an open position for use on the stadium bench and a closed position for carrying and storage;

means hinging the side slappers to the side walls for selective movement of the side slappers toward or away from the base of the seat portion when the seat portion and the backrest are folded together for storage or folded open for use.

* * * * *